United States Patent [19]

Allen et al.

[11] Patent Number: 4,890,938

[45] Date of Patent: Jan. 2, 1990

[54] WOODEN DRAWER GUIDE

[75] Inventors: Thomas E. Allen, Thomasville; Matt C. Scalf; John G. Lampe, both of High Point, all of N.C.

[73] Assignee: Armstrong World Industries, Inc., Lancaster, Pa.

[21] Appl. No.: 254,223

[22] Filed: Oct. 6, 1988

[51] Int. Cl.[4] ..... F16C 33/02

[52] U.S. Cl. ..... 384/21; 384/23

[58] Field of Search ..... 384/23, 42, 21, 20, 384/22, 38, 40; 312/341 NR, 348

[56] References Cited

U.S. PATENT DOCUMENTS 3,477,770 11/1969 Niemi ..... 384/23

3,498,685 3/1970 Poplinski ..... 384/40

3,658,394 4/1972 Gutner ..... 384/21

4,334,715 6/1982 Schreiner ..... 384/21

*Primary Examiner*—Lenard A. Footland

[57] ABSTRACT

A conventional dovetail slot is formed in a wooden guide which is attached to the bottom of a drawer. A rubber or plastic wedge is secured in one end of the slot and tapers outwardly towards the end of the slot. A runner having a dovetail-shaped tongue moves relative to the guide and slides in the slot. The inner surface of the tongue is concave so that the tongue can slide over the wedge. However, a screw or other projection on the tongue contacts the wedge to form a stop when the drawer reaches the full open position.

1 Claim, 1 Drawing Sheet

WOODEN DRAWER GUIDE

BACKGROUND OF THE INVENTION

1. Field of the Invention

The invention is directed to a stop system for a dovetail type drawer guide.

2. Description of the Prior Art

U.S. Pat. No. 3,813,132 is a showing of a dovetail guide structure.

U.S. Pat. No. 1,285,708 is a showing of a drawer structure where a wedge 20 and screw 21 are utilized, but they are utilized at the back of a drawer as a stop structure to limit the extent of inward movement of the drawer into the case goods.

SUMMARY OF THE INVENTION

In a slide guide for a drawer adapted to the position within the base frame of a piece of case goods, there is provided a combination of two slide guides. The first elongated upper slide guide is provided with a dovetail mortise groove cut in its lower surface and a drawer is fastened to this slide guide. A second elongated slide guide member is provided with a dovetail tenon cut in its upper surface and it is supported on the base frame of the case goods. The tenon and mortise have inclined sidewalls whereby the tenon is slideably retained in the mortise due to the inclined sidewalls. A concave space exists between the tenon and mortise. Into this space a means is provided preventing the tenon from sliding out of the mortise. However, the means does permit the first and second guide members to slide together relative to each other into engagement when the drawer is first placed in the case goods. Then when the drawer is partly pulled from the case goods, the means prevents the two part structure from coming apart. The means is a first part having a raised projection extending from the tenon into the space between the tenon and mortise. A second part is a wedge-shaped structure near one end of the mortise groove with the wedge-shaped structure having a surface projecting into said space between the tenon and mortise so that the wedge projected surface engages the raised projection to prevent the separation of the mortise and tenon.

The wedge-shaped structure is tapered from its one end to its opposite end forming a raised surface. When the mortise and tenon are first slid together, the raised projection of the tenon slides up the inclined surface because the wedge-shaped structure is sufficiently resilient to yield under the pressure of the projection. However, once the projection has slide past the wedge-shaped member, when attempting to slide the two guides relative to each other, the projection will engage the projection surface of the wedge and prevent the two slide guides from separating.

DESCRIPTION OF THE PREFERRED EMBODIMENT

Figure 1:
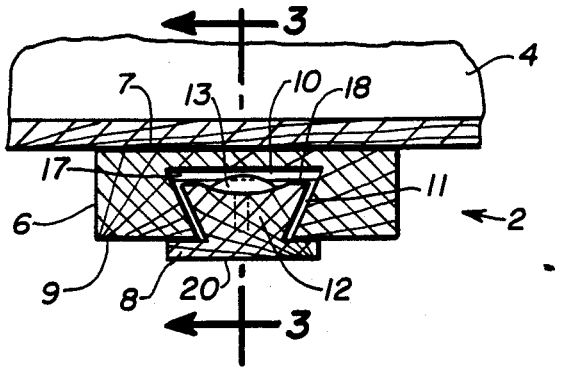
FIG. 1 is an end view of the drawer guide.

A slide guide 2 for a drawer 4 is adapted to be positioned within the base frame 14 and 16 of a piece of case goods. The slide guide is the combination of a first elongated upper slide guide member 6 with an upper surface 7 and lower surfaces 8 and 9 and a dovetail mortise 11 cut in the lower surface of the slide guide 6. A drawer 4 is fastened to the upper surface of the slide guide 6. A second elongated lower slide guide member 8 is provided with an upper surface 18 and a lower surface 20 and a dovetail tenon 12 is cut in the upper surface of the slide guide 8. The lower surface of the slide guide 8 is supported on the base frame 14 and 16 of a piece of case goods. The tenon 12 and the mortise 11 which are the above-described dovetail tenon 8 and dovetail mortise groove 11 have inclined sidewalls whereby the tenon is slideably retained in the mortise groove due to the incline sidewalls. The upper surface of the tenon between its sidewalls is concave and spaced slightly from the base of the groove of the mortise between its sidewalls.

Normally the tenon would be capable of sliding out of the mortise groove when said drawer is withdrawn from within said case goods. A means is provided to prevent the tenon from sliding out of the mortise. Normally, the means will permit movement of the first and second guide members to slide relative one to the other so that the drawer may be partially drawn from the case goods. However, the means will prevent complete withdrawal of the drawer from the case goods.

Figure 2:
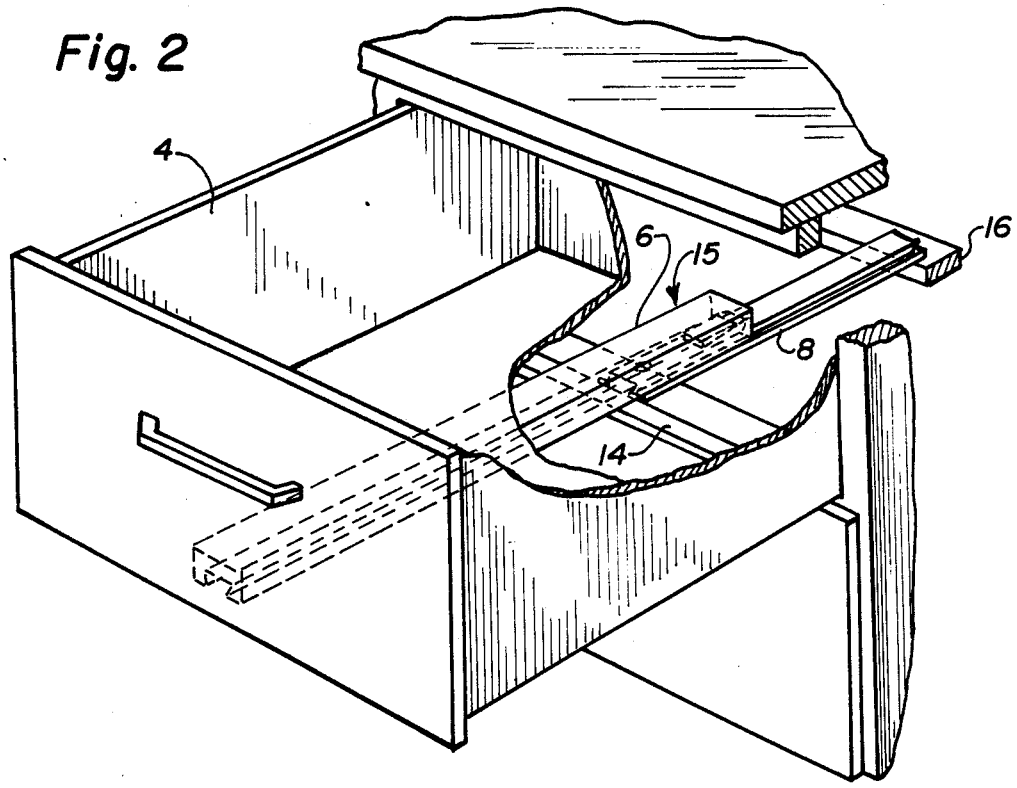
FIG. 2 is a view of the drawer guide in a chest.
Figure 3:
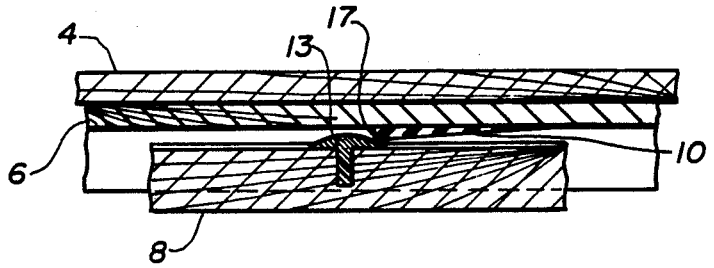
FIG. 3 is a sectional view of the guide structure showing the engagement of the projection and the wedge invention.

The means is a two-part structure having a first part 13 which is a raised projection extending from the tenon into the space between the tenon and mortise groove. The second part is a wedge-shaped structure 10 near one end of the mortise groove with the wedge-shaped having a surface 17 projecting into the space between the tenon and mortise. This wedge-shaped element would be positioned generally in the region 15 shown in FIG. 2 and prevents the drawer 4 from being fully removed from the case goods. FIG. 3 is a showing of the projection and wedge in engagement to prevent the drawer from being removed from the case goods. The left side of the wedge forms the surface 17 which extends into the area between the top of the tenon and the bottom of the mortise groove and it is surface 17 of the wedge that engages the projection 13.

The wedge-shaped 10 is tapered from its right side as shown in FIG. 3 to its left side in FIG. 3. Its right side is basically flush with the base of the mortise groove and on its left side it is raised above the base of the mortise groove and forms the projecting surface 17. This surface projects into the space between the top of the tenon and the base of the mortise groove. When the drawer 4 is initially placed within the case goods and it would move from the left to the right in FIG. 2, the placing of the tenon into the mortise can be carried out with the raised projection 13 riding up the tapered surface of the wedge and passing over the surface 17. If the mortise groove 6 with the drawer was initially being placed on the tenon on the lower guide 8, the upper guide 6 would have initially moved from left to right in FIG. 3 and that figure shows the structure after the projection has risen up the tapered surface of wedge 10 and then got into position behind surface 17 of the wedge. Now any movement attempting to move element 6 from right to left is prevented by surface 17 engaging projection 13. The wedge-shaped structure 10 is sufficiently resilient, because it is made of hard rubber or plastic as is the wood supporting structure 10, to yield under the pressure of said projection when the slide members are engaging initially with each other, but the wedge-shaped structure, and particularly its surface 17, will not yield when the projection on the tenon and the wedge surface 17 on the mortise engage when there is a movement to separate the engaged slide guide members. That is, to remove the drawer completely from the case goods.

What is claimed is:

1. A slide guide for a drawer adapted to be positioned within the base frame of a piece of case goods, said slide guide comprising:

the combination of a first elongated upper slide guide member with upper and lower surfaces and a dovetail mortise groove cut in the lower surface and a drawer fastened to the upper surface, a second elongated lower slide guide member with upper and lower surfaces and a dovetail tenon cut in the upper surface and the lower surface being supported on the midregion of the base frame of said piece of case goods, said tenon and mortise having inclined sidewalls whereby the tenon is slideably retained in the mortise due to the inclined sidewalls and the surface of the tenon between its sidewalls being spaced slightly from and parallel to the surface of the base of the mortise between its sidewalls, said tenon being capable of sliding out of the mortise when said drawer is drawn from within said case goods, a means preventing said tenon from sliding out of the mortise, but otherwise permitting the first and second guide members to slide relative to each other in engagement with each other when the drawer is partly drawn from said case goods, said aforesaid means being a two part structure having a first part being a raised projection extending from the tenon into said space between the tenon and mortise, said second part being a wedge shaped structure near one end of mortise groove with the wedge shaped structure having a surface projecting into said space between the tenon and mortise so that the wedge projecting surface engages said raised projection to prevent the separation of the mortise and tenon, the wedge shaped structure is tapered from the top of the surface projecting into said space at one end of the wedge to the opposite end of the wedge located near the end of the mortise whereby the mortise and tenon can be moved from a separated state to an engaged state and the sliding of the tenon into the mortise can be carried out with said raised projection riding up the tapered surface of the wedge and passing over the wedge surface projecting into said space between the mortise and tenon, said wedge shaped structure being sufficiently resilient to yield under the pressure of said projection when the slide guide members are engaged with each other, but not yield when the projection on the tenon and wedge projection surface on the mortise engage when there is movement to separate the engaged slide guide members.

* * * * *